United States Patent [19]

Williams

[11] B 3,994,472

[45] Nov. 30, 1976

[54] ANNULAR TYPE BLOWOUT PREVENTER

[75] Inventor: Bolie C. Williams, Houston, Tex.

[73] Assignee: Cameron Iron Works, Inc., Houston, Tex.

[22] Filed: Jan. 17, 1975

[21] Appl. No.: 541,710

[44] Published under the second Trial Voluntary Protest Program on February 24, 1976 as document No. B 541,710.

[52] U.S. Cl. ..... 251/1 B; 251/9; 277/128

[51] Int. Cl.[2] ..... E21B 33/06

[58] Field of Search ..... 251/1, 4, 5, 9; 277/73, 277/126–129; 138/45; 285/152; 92/137

[56] References Cited

UNITED STATES PATENTS

| | | | |
|---|---|---|---|
| 2,434,835 | 1/1948 | Colley | 251/4 X |
| 2,609,836 | 9/1952 | Knox | 277/73 |
| 3,572,627 | 3/1971 | Jones | 251/1 |
| 3,737,139 | 6/1973 | Watts | 251/1 |

FOREIGN PATENTS OR APPLICATIONS

| | | | |
|---|---|---|---|
| 961,045 | 3/1957 | Germany | 251/5 |

*Primary Examiner*—Martin P. Schwadron
*Assistant Examiner*—Richard Gerard
*Attorney, Agent, or Firm*—W. F. Hyer; Marvin B. Eickenroht

[57] ABSTRACT

There is disclosed an annular blowout preventer wherein a plurality of flexible bands are arranged about the packer within the recess about the bore through the preventer housing, and means are provided for moving the bands toward and away from the bore so as to selectively contract the packer into sealing engagement about an object in the bore or upon itself when the bore is empty or permit said packer to expand into the recess.

14 Claims, 6 Drawing Figures

ANNULAR TYPE BLOWOUT PREVENTER

This invention relates to improvements in an annular blowout preventer wherein a packer comprising a massive annulus of resilient material is mounted within a recess about a bore through a preventer housing in position to be contracted into sealing engagement about an object in the bore or upon itself when the bore is empty.

In an early preventer of this type shown and described in U.S. Pat. No. 2,609,836, a conically shaped outer side of the annulus is seated upon a similarly shaped upper end of an annular piston which is vertically reciprocable within the housing, so that, as the piston is moved upwardly, its upper end slides over the outer side of the annulus to seal thereabout and contract the packer. As the packer is so contracted, the upper end of the annulus is slidable sealably along the top side of the recess, and its lower end is spaced above the bottom side of the recess. Consequently, when the annulus is sealably engaged on itself or an object in the bore, well pressure within the bore of the preventer body is effective across its outer surface to assist the force of the piston in maintaining it in closed position.

The requirement that the housing be high enough to permit the required vertical stroke of the piston is often a problem since headroom is at a premium in the environment in which blowout preventers are used. Also, since the piston must slide over a substantial portion of the outer side of the annulus, it requires considerable operating force, which adds to the size and cost of the preventer.

U.S. Pat. Nos. 3,572,627 and 3,572,628 show and describe a subsequent preventer of this type in which the packer is circumferentially contracted by means of arcuate metal segments disposed about the annulus within the recess of the housing. The segments are in turn connected to pistons radially reciprocable within cylinders formed in the outer side of the housing by means of rods extending sealably through holes in walls of the housing separating the recess from the cylinders. As noted in such patents, since the pistons and cylinders for so contracting the packer are arranged horizontally, they require no more height within the housing than does the packer itself, so that the housings of preventers of this construction are more shorter than those of the earlier preventers. Furthermore, since there is only a small amount of relative sliding between the arcuate segments and the annulus, these latter preventers have lower operating pressure requirements.

Although preventers of this latter construction are therefore substantial improvements over the earlier preventers of this type, they are nevertheless relatively expensive to manufacture, due primarily to the large number of pistons and cylinders required to operate the contracting segments. Thus, in order for them to maintain contact with the outer circumference of the annulus as it contracts, each segment must be of relatively small arcuate extent. At the same time, to prevent distortion of the annulus, there must be enough segments to cause their ends to be substantially adjacent the ends of adjacent segments when the annulus is contracted.

An object of this invention is to provide a preventer of this type which is similar to those above described in that it has a relatively short housing, but which requires substantially fewer horizontally arranged operating pistons and cylinders.

Another object is to provide such a preventer which, similarly to those above described, has packer contracting elements which have only a small amount of sliding contact with the annulus.

A further object is to provide such a preventer which employs contracting elements which require only a small annular space between the annulus and recess in the housing, and which are less expensive to manufacture than those above described.

These other objects are accomplished, in accordance with the illustrated embodiment of the invention, by a preventer of this type having a plurality of flexible bands arranged within the recess and about the packer in substantially equally spaced relation, and means for moving each band toward the bore so as to contract the packer into sealing engagement with an object in the bore of the housing or upon itself when the bore is empty, and away from the bore so as to permit the packer to expand into the recess. Since the flexible bands are free to conform to the changing outer circumference of the packer, they may be of considerable circumferential extent so that only a small number of bands, and thus with a small number of pistons and cylinders or other mechanisms for moving them, are required.

When the packer is contracted to seal upon itself, each end of each band is substantially adjacent an end of an adjacent band so that the bands surround a maximum circumferential extent of the packer at all times. Also, each band is of substantially the same height as the annulus, so as to distribute its load evenly about the outer surface thereof. Furthermore, when the packer is expanded, the bands are substantially adjacent the outer periphery of the recess so as to minimize the required radial extent of the preventer housing.

Preferably, each band is pivotally connected at one end to the housing and at the other end to an actuator which is reciprocably mounted on the housing so that the actuator may be moved in opposite directions to move the band toward or away from the bore. In this way, only one actuator is required for moving each band in the required manner.

In the preferred and illustrated embodiment of the invention, the pivotal connection of one end of each band to the housing comprises an arm pivotally connected to each of the end of the band and the housing, and the axis of reciprocation of the actuators and the pivotal connections of the arms are arranged to maintain the ends of the bands against the packer during its expansion and contraction. More particularly, each actuator comprises a rod which is arranged to push the end of the band to which it is connected in moving the band toward the bore, and the pivotal connection of each arm to the housing is arranged circumferentially between the pivotal connections of the ends of the band to said arm and rod. Thus, the pivotal connections do not interfere with one another as the ends of adjacent bands are brought into adjacent positions relative to one another.

The housing has pockets about the periphery of the recess each adapted to receive an arm when the packer is expanded, thereby minimizing the annular space required between the outer periphery of the packer and the outer periphery of the recess. As illustrated, the actuator comprises a rod and the means for reciprocating it comprises a cylinder in the body and a piston on the rod reciprocable in the cylinder. In the drawings.

Figure 1:
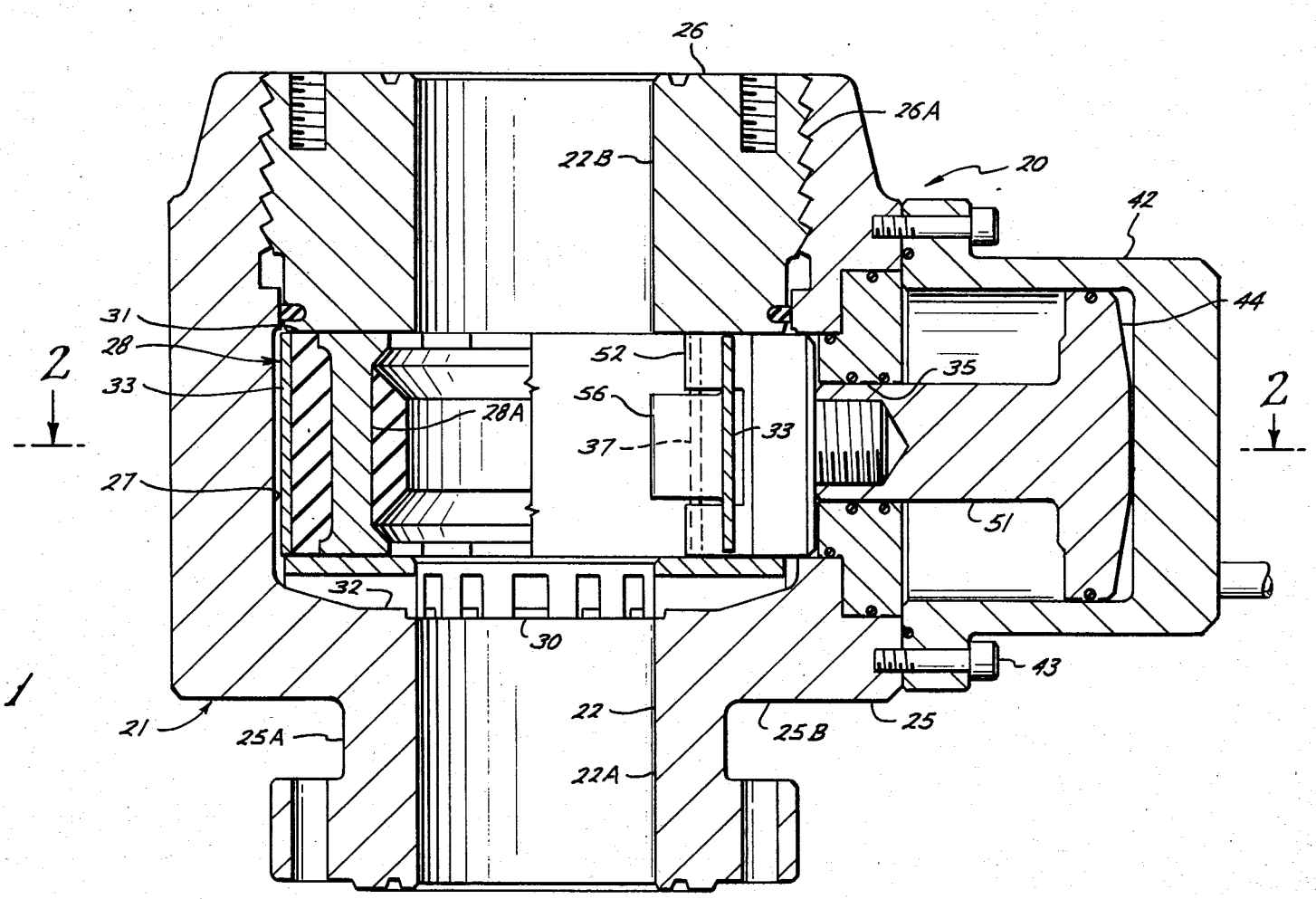
FIG. 1 is a vertical sectional view of a blowout preventer constructed in accordance with the present invention, as seen along broken lines 1—1 of FIG. 2, and with the packer thereof shown in expanded position.

With reference now to the details of the above-described drawings, the illustrated blowout preventer, which is indicated in its entirety by reference character 20, includes a housing 21 having a vertical bore 22 therethrough, and upper and lower ends adapted to be connected in a conventional manner to parts of a wellhead (not shown) with its bore forming a continuation of the wellhead bore. Housing 21 includes a body 25 having a lower tubular portion 25A in which the lower end 22A of the housing bore is formed, an end wall 25B extending outwardly from the tubular portion, and an outer annular wall 25C extending upwardly from the outer end of end wall 25B. The housing also includes a bonnet 26 which forms the upper end 22B of housing bore 22, and is threadedly connected at 26A to the upper end of body wall 25C. With the body and bonnet so connected, the bottom side of the bonnet is spaced above the top side of end wall 25B of the body to define an annular recess 27 about the bore of the housing.

Figure 2:
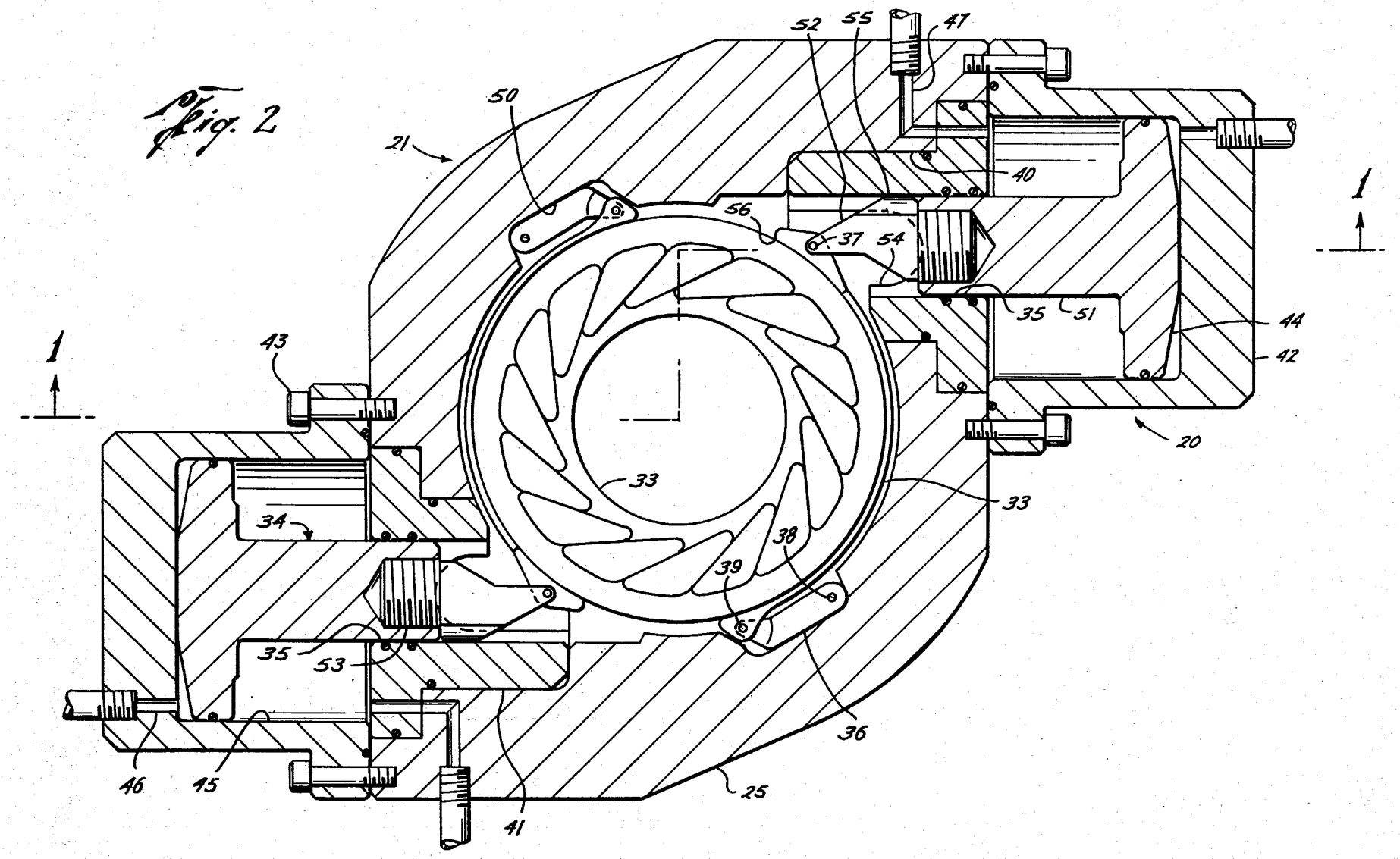
FIG. 2 is a horizontal sectional view of the preventer, as seen along broken lines 2—2 of FIG. 1.
Figure 3:
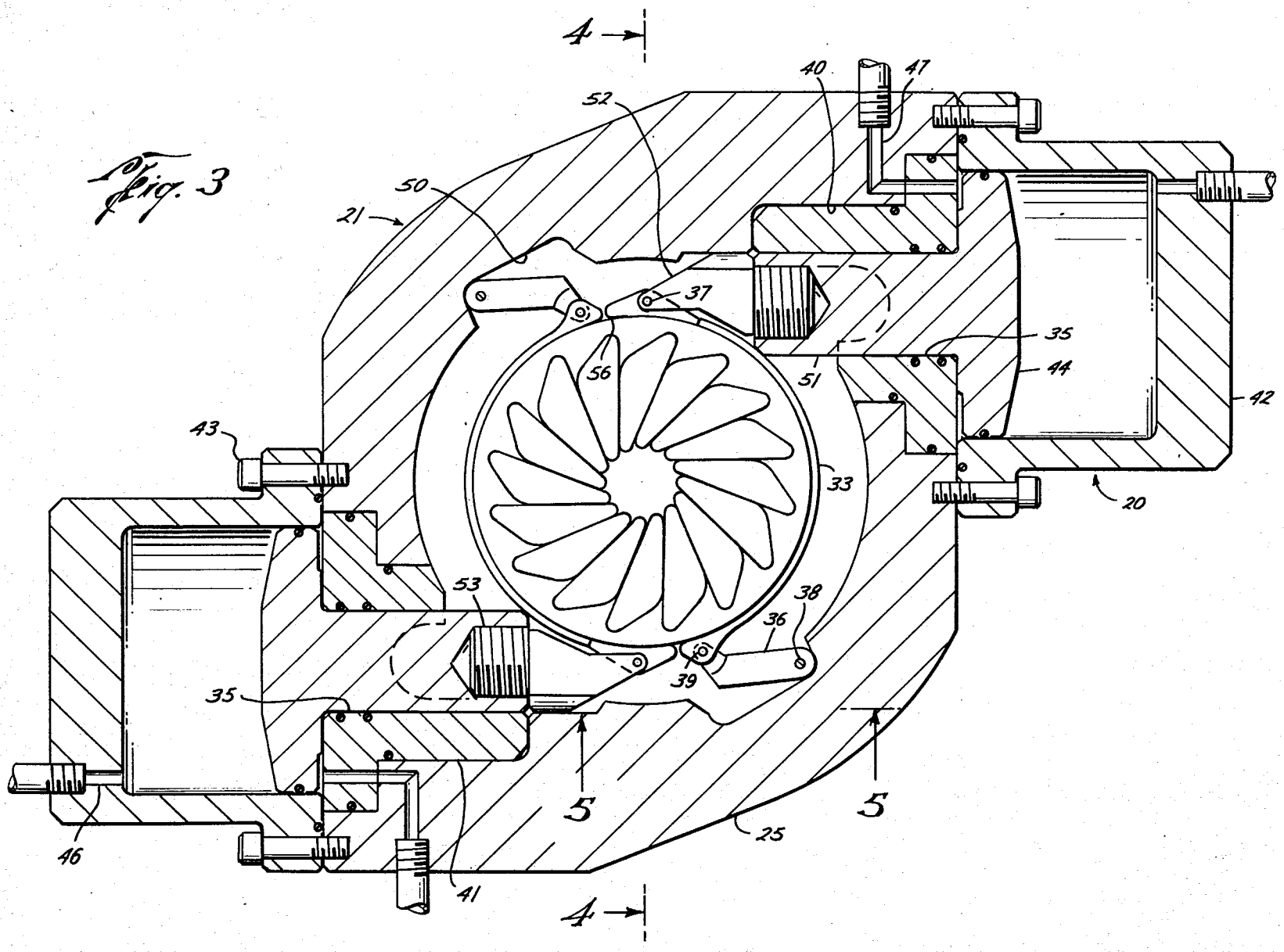
FIG. 3 is a horizontal sectional view of the preventer, similar to FIG. 2, but with the packer contracted to seal upon itself.
Figure 4:
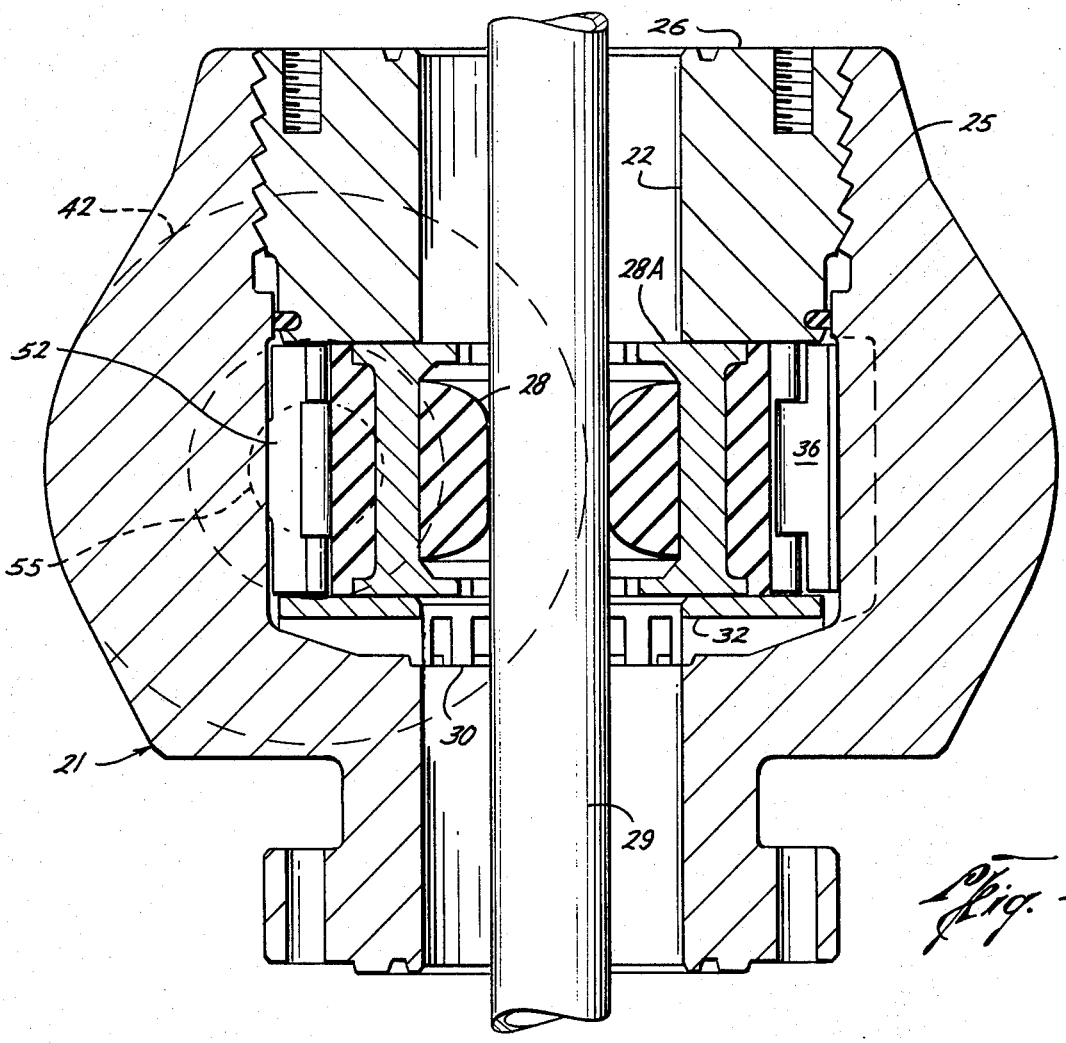
FIG. 4 is a vertical sectional view of the preventer, as seen along broken lines 4—4 of FIG. 3, but with the packer contracted into sealing engagement with a pipe extending through the bore of the preventer housing.

A packer 28 comprising a reinforced annulus of rubber or other resilient material is received within recess 27 for movement between an outer expanded position in which its bore is substantially aligned with the housing bore, as shown in FIGS. 1 and 2, and an inner contracted position in which it is adapted to close the bore through the housing. Thus, as shown in FIG. 3, with the bore empty, the packer may be contracted a maximum extent to seal upon itself, or, as shown in FIG. 4, the packer may be contracted to a lesser extent so as to seal about a pipe 29 in the housing bore.

The packer annulus is reinforced by metal inserts 28A in a manner shown in U.S. Pat. Nos. 3,572,627 and 3,572,628, and its lower end is radially slidable over a bridge 30 supported on the bottom side of the recess 27. The upper end of the annulus has a circumferential surface 31 adjacent its outer diameter which is sealably slidable across the top side of the recess as the packer moves inwardly to contracted position. The outer surface of the expanded packer is disposed concentrically, but spaced a short distance inwardly, of the recess 27 so as to provide an annular space therebetween, and this space is connected to the bore of the housing beneath the packer by means of slots 32 in the bridge 30. Thus, well pressure has access to the outer surface of the packer to provide an inwardly directing force for assisting operating pressure in maintaining the packer closed.

A pair of flexible bands 33 are disposed about opposed sides of the packer within the recess. As previously described, each is of a height corresponding to that of the packer. The bands are made of a material such as spring steel which is substantially non-extendible, so that it will not stretch a substantial amount even though the bands are tensioned by the outward radial force of the packer thereagainst.

As previously described, one end of each band is pivotally connected to a rod 34 mounted for reciprocation within a guideway 35 in the housing, and the other end thereof is pivotally connected to the housing by means of an arm 36. More particularly, the one end of each band is connected to the inner end of a rod 34 by means of a pivot pin 37, and the opposite ends of each arm 36 are connected to the housing and the other end of a band by means of pivot pins 38 and 39, respectively. With a pair of bands, as illustrated, the pins 37 and 39 are diametrically opposed, and the bands are disposed about diametrically opposed circumferential portions of the packer. As shown, each band is of such length as to cause it to be close about the packer when expanded (FIG. 2) and to cause its opposite ends to be substantially adjacent the ends of the other band when the packer is fully contracted (FIG. 3).

As previously described, each rod reciprocates along an axis which causes the end of the band to which it is connected to be maintained against the packer as it is contracted from the position of FIG. 2 to that of FIGS. 3 and 4. Also, the pivot pins of each arm 36 are so arranged that a band will be held against the packer as it is contracted in response to the inward movement of the rod. Consequently, as will be understood from a a comparison of FIG. 2 with FIGS. 3 and 4, the entire circumference of the band will be maintained in engagement with the packer at all times.

As shown, each rod reciprocates along an axis which is parallel to the axis of reciprocation of the other rod and which passes through a side of the packer, when the packer is expanded. Thus, when the packer is fully contracted, as shown in FIG. 3, the axes of the rods are substantially tangent to the packer.

The outer wall 25C of housing body 25 is provided with a pair of counterbores 40 each of which sealably receives an adapter 41 in which a guideway 35 is formed to receive a rod 34 for sealably sliding therein. The housing also includes a pair of caps 42 each connected by bolts 43 to the body wall 25C coaxially of a guideway, and a piston 44 provided on the outer end of the rod is sealably slidable within a cylinder 45 formed within the cap. Ports 46 and 47 in the housing connect with the cylinder 45 on opposite sides of the piston 44, whereby fluid under pressure may be selectively admitted to or exhausted therefrom in order to reciprocate the rod 34.

A pair of pockets 50 are formed in diametrically opposed portions of the outer circumference of the recess 27, each to receive an arm 36 when the arm is swung outwardly to accommodate full expansion of the packer. In order to maintain the end of the band to which each arm is connected engaged with the annulus, pivot pin 38 which connects each arm to the housing is located outwardly of a plane tangent to the outer circumference of the annulus at the point of engagement of the end of the band therewith.

Thus, as will be understood from a comparison of FIGS. 2 and 3, inward movement of each rod 34 will pull the end of the band to which it's connected about the packer in a counterclockwise direction, which in turn pulls the opposite end of the band out of recess 50. As will be understood from FIG. 3, even though the ends of the bands are moved into positions adjacent one another when the packer is fully contracted, there will be no interference between the rods and arms to which they are connected since these latter parts extend in a direction away from the ends of the bands.

When it is desired to return the packer to its fully expanded position, it is merely necessary to retract or move the rods outwardly, which permits the ends of the bands to which the rods are connected to slide about the packer in a clockwise direction under the influence of the expanding packer. Then, as the rods are fully retracted and the packer fully expanded, the arms 36 will have moved back into their recesses.

Each rod 34 includes an outer stem 51 integral with the piston 44, and a yoke 52 connected to the inner end of the stem by means of threads 53. Each yoke is upright and of relatively thin configuration so as to prevent interference with the inner end of the band to which it's connected, and the inner end of each adapter 41 is recessed at 54 so as to receive its yoke in the full retracted position of the rod. The outer side of each yoke is flat for sliding over a flat surface on adjacent side of its adapter, so as to prevent the yoke from rotating within the adapter. A rib 55 formed on the flat side of each yoke is received within a correspondingly shaped slot 56 in the flat side of its adapter so as to prevent the inner end of the yoke from tipping downwardly as it moves inwardly toward the housing bore.

Figure 5:
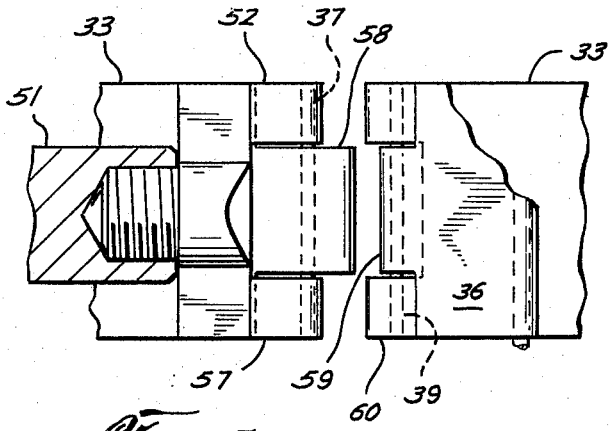
FIG. 5 is a side elevational view, as seen along broken line 5—5 of FIG. 3, of the connections of adjacent ends of the bands.
Figure 6:
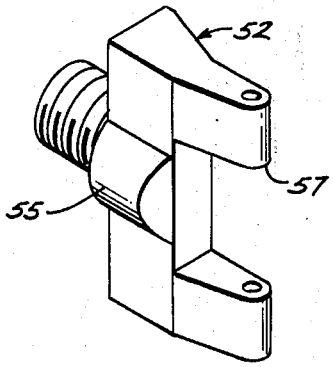
FIG. 6 is an isometric view of a yoke on the inner end of the piston rod for connection to one end of a band.

As best shown in FIGS. 5 and 6, each yoke has upper and lower arms 57 on its inner end which receive a reduced connector part 58 on the end of the band, and the arms and the connector part are provided with aligned holes to receive pivot pin 37. The end of each arm 36 is reduced at 59 and received between upper and lower arms 60 of a connector part at the other end of the band, and these arms and the connector part are also provided with aligned holes to receive pivot pin 39.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the acompanying drawings is to be interpreted as illustrative and not in a limiting sense.

The invention having been described, what is claimed is:

1. An annular blowout preventer, comprising a housing having a bore therethrough and an annular recess about the bore, a packer including an annulus of resilient material within the recess, a plurality of flexible bands arranged within the recess about the packer in substantially equally spaced relation, means pivotally connecting one end of each band to the housing, a plurality of actuators each mounted for reciprocation in the housing and pivotally connected to the other end of each band, and means for moving each actuator in one direction to move said band toward the bore in order to contract the packer into sealing engagement about an object in the bore or upon itself when the bore is empty, and in another opposite direction to move said band away from the bore in order to permit the band to expand into the recess.

2. A preventer of the character defined in claim 1, wherein each end of each band is substantially adjacent the end of an adjacent band when the packer is contracted into sealing engagement with itself.

3. A preventer of the character defined in claim 2, wherein each band extends vertically throughout substantially the entire height of the annulus.

4. A preventer of the character defined in claim 1, wherein each actuator is a rod arranged to push the end of the band to which it is connected in moving the band toward the bore.

5. An annular blowout preventer, comprising a housing having a bore therethrough and an annular recess about the bore, a packer including annulus of resilient material within the recess, a plurality of flexible bands arranged within the recess about the packer in substantially equally spaced relation, a plurality of rods each pivotally connected to one end of a band and mounted in the housing for reciprocation, a plurality of arms each pivotally connected to the other end of a band and to the housing, and means for moving each rod in one direction to swing each band about the arm to which it is connected in order to move said band toward the bore for contracting the packer into sealing engagement about an object in the bore or upon itself when the bore is empty, and in the opposite direction to swing said band about said arm in order to move said band away from the bore in order to permit the packer to expand into the recess, the axis of reciprocation of the rods and the pivotal connections of the arms being arranged to maintain the ends of the bands against the packer during such contraction.

6. A preventer of the character defined in claim 5, wherein each end of each band is substantially adjacent the end of an adjacent band when the packer is contracted into sealing engagement with itself.

7. A preventer of the character defined in claim 6, wherein each band extends vertically throughout substantially the entire height of the packer.

8. A preventer of the character defined in claim 5, wherein the pivotal connection of each arm to the housing is arranged circumferentially between the pivotal connections of the ends of the band to said arm and rod.

9. A preventer of the character defined in claim 8, wherein the housing has pockets therein about the periphery of the recess, each pocket receiving an arm when the annulus is expanded.

10. A preventer of the character defined in claim 5, wherein each rod moves in said one direction to push the end of the band to which it is connected toward the housing bore.

11. A preventer of the character defined in claim 10, wherein the means for reciprocating each rod comprises a cylinder in the body and a piston on the rod reciprocable in the cylinder.

12. An annular blowout preventer, comprising a housing having a bore therethrough and an annular recess about the bore, a packer including an annulus of resilient material within the recess, a plurality of substantially inextensible, flexible bands arranged within the recess and about the packer in substantially equally spaced relation, and means connected to opposite ends of each band for moving it toward the bore so as to contract the packer into sealing engagement about an object in the bore or upon itself when the bore is empty, and away from the bore so as to permit said packer to expand into the recess, each end of each band being substantially adjacent the end of an adjacent band when the packer is contracted into sealing engagement upon itself.

13. A preventer of the character defined in claim 12, wherein each band extends vertically throughout substantially the entire height of the annulus.

14. An annular blowout preventer, comprising a housing having a bore therethrough and an annular recess about the bore, a packer including an annulus of resilient material within the recess, a plurality of substantially inextensible, flexible bands arranged within the recess and about the packer in substantially equally spaced relation, and means connected to opposite ends of each band for moving it toward the bore so as to contract the packer into sealing engagement about an object in the bore or upon itself when the bore is empty, and away from the bore so as to permit said packer to expand into the recess, each bank extending vertically throughout substantially the entire height of the annulus.

* * * * *